US006232994B1

(12) United States Patent
Wiklof

(10) Patent No.: US 6,232,994 B1
(45) Date of Patent: May 15, 2001

(54) NOISE CANCELLATION SYSTEM FOR A THERMAL PRINTER

(75) Inventor: Christopher A. Wiklof, Everett, WA (US)

(73) Assignee: Intermec IP Corp., Woodland Hills, CA (US)

( * ) Notice: Subject to any disclaimer, the term of this patent is extended or adjusted under 35 U.S.C. 154(b) by 0 days.

(21) Appl. No.: 09/162,499

(22) Filed: Sep. 29, 1998

(51) Int. Cl.[7] ..... B41J 35/16
(52) U.S. Cl. ..... 347/177; 347/171
(58) Field of Search ..... 347/173, 175, 347/177, 219, 139, 171, 23; 395/115; 73/862.41; 346/76 PH; 364/550; 181/200; 379/100

(56) References Cited

U.S. PATENT DOCUMENTS

| | | | | |
|---|---|---|---|---|
| 4,665,549 | | 5/1987 | Eriksson et al. . | |
| 4,677,676 | | 6/1987 | Eriksson . | |
| 4,677,677 | | 6/1987 | Eriksson . | |
| 4,736,431 | | 4/1988 | Allie et al. . | |
| 4,953,217 | | 8/1990 | Twiney et al. . | |
| 4,985,925 | | 1/1991 | Langberg et al. . | |
| 5,148,887 | | 9/1992 | Murphy . | |
| 5,175,563 | * | 12/1992 | Fushimoto et al. . | |
| 5,278,780 | | 1/1994 | Eguchi . | |
| 5,305,387 | | 4/1994 | Sapiejewski . | |
| 5,384,853 | | 1/1995 | Kinoshita et al. . | |
| 5,418,858 | | 5/1995 | Shoureshi . | |
| 5,430,664 | * | 7/1995 | Cargill et al. | 364/550 |
| 5,434,925 | | 7/1995 | Nadim . | |
| 5,448,637 | | 9/1995 | Yamaguchi et al. . | |
| 5,477,013 | * | 12/1995 | Okugawa et al. | 181/200 |
| 5,485,523 | | 1/1996 | Tamamura et al. . | |
| 5,490,237 | * | 2/1996 | Zimmerman | 395/115 |
| 5,497,426 | | 3/1996 | Jay . | |
| 5,559,893 | | 9/1996 | Krokstad et al. . | |
| 5,577,504 | | 11/1996 | Salloway et al. . | |
| 5,593,238 | * | 1/1997 | Fox et al. | 347/219 |
| 5,602,478 | | 2/1997 | Salloway et al. . | |
| 5,606,607 | | 2/1997 | Yamaguchi et al. . | |
| 5,629,986 | | 5/1997 | Shoureshi . | |
| 5,636,286 | | 6/1997 | Makabe et al. . | |
| 5,664,014 | | 9/1997 | Yamaguchi et al. . | |
| 5,805,678 | * | 6/1999 | Okamoto et al. | 379/100 |
| 5,912,693 | * | 6/1999 | Katsuma et al. | 347/175 |
| 5,940,185 | * | 8/1999 | Inoue et al. | 347/23 |
| 6,025,856 | * | 2/2000 | Ozawa et al. | 347/139 |

* cited by examiner

*Primary Examiner*—N. Le
*Assistant Examiner*—K. Feggins
(74) *Attorney, Agent, or Firm*—O'Melveny & Myers LLP

(57) ABSTRACT

A noise cancellation apparatus provides an inexpensive mechanism that is readily adaptable for printers and other equipment and devices that are used in areas where external noise is undesirable. In an embodiment of the present invention, a thermal printer includes a transport mechanism for transporting a media through the thermal printer and a thermal print head for printing on the media. At least one sound emitter is provided for generating an inverse sound signal to cancel noise generated by at least one noise source in the thermal printer. At least one microphone is provided for receiving sound signals from the at least one noise source. Each microphone is connected to an inversion circuit which inverts the received sound signals. The inversion circuit sends the inverted sound signal to one of the sound emitters, which emits the inverted sound signal, canceling out the noise. To ensure a proper phase relationship between the inverted sound signal and the sound signals generated by the noise source, the sound emitter is placed as close as possible to the noise source. Further, a low pass filter is provided between the microphone and the inversion circuit to filter out noise having a frequency greater than c/2d, where c is the speed of sound and d is the distance between the emitter and the noise source. Sound dampening materials are disposed in the thermal printer to cancel out the remaining high frequency noise that is within the range of human hearing.

23 Claims, 9 Drawing Sheets

($\lambda = \frac{1}{3}d$)

($\lambda$=4d)

NOISE CANCELLATION SYSTEM FOR A THERMAL PRINTER

BACKGROUND OF THE INVENTION

1. Field of the Invention

The present invention relates to thermal printers and more particularly, to the utilization of inverted acoustic signals for noise cancellation in a thermal printer.

2. Description of Related Art

In the field of bar code symbology, vertical bars of varying thicknesses and spacing are used to convey information, such as an identification of the object to which the bar code is affixed. Bar codes are often printed onto a print media comprising individual paper substrate labels having an adhesive backing layer that enables the labels to be affixed to objects to be identified. Since the bar and space elements have differing light reflective characteristics, the information contained in the bar code can be read by interpreting the reflected light or image pattern from the bar code using known optical scanning systems. In order to accurately read the bar code, it is thus essential that the bar code be printed in a high quality manner, without any streaking, blurring or misregistration of the bar code. At the same time, it is essential that the adhesive backing layer of the labels not be damaged by heat generated during the printing process.

In view of these demanding printing requirements, bar codes are often printed using direct thermal or thermal transfer printing techniques. In direct thermal printing, a print media is impregnated with a thermally sensitive chemical that is reactive upon exposure to heat for a period of time. Thermal transfer printing requires an ink ribbon that is selectively heated to transfer ink to the print media. These two printing techniques are referred to collectively herein as thermal printing.

In operation, a print media is drawn between a platen and a thermal print head of the thermal printer. The thermal print-head has linearly disposed printing elements that extend across a width dimension of the print media. The printing elements are individually activated in accordance with instructions from a printer controller. As each printing element is activated, the thermally active chemical of the ribbon (or print media in direct thermal printing) activates at the location of the particular printing element to transfer ink to the printed area of the print media. The print media is continuously drawn through the region between the platen and the thermal print head, and in so doing, images such as bar codes, text, characters and graphics are printed onto the print media as it passes through the region.

Low performance thermal printers are relatively quiet, allowing for their use in offices, hospitals and other environments where excessive noise would be undesirable. High performance thermal printers are faster and print with at a higher print quality than low performance thermal printers. Unfortunately, this increase in speed and quality comes at the cost of a higher external noise output. The noise outputs for high performance thermal printers may reach or exceed 79 dB (approximately the noise level of busy city traffic) making high performance thermal printers undesirable for use in offices, hospitals or other environments where noise is a concern.

Prior attempts to reduce noise emission in thermal printers have been inadequate. For example, it is known that reducing the print speed reduces noise output, but this also reduces the performance of the thermal printer. Also, some noise can be reduced by changing the pressure/alignment relationship of the print head to the paper; however, this is unfavorable due to heat transfer, media flexibility, and/or cost limitations. Soundproofing materials have also been added to the printer, but relying solely on soundproofing methods increases the cost and weight of the thermal printers and is further limited by cooling limitations. A further limitation of soundproofing methods is that they only achieve maximum effectiveness at relatively high frequencies.

In other fields, noise cancellation has been achieved by fixing a speaker at a position relatively close to a listener and emitting an inverted cancellation signal towards the direction of the listener. For example, in one prior art approach, a microphone is positioned on a set of headphones to receive sound waves before they reach the ears of the listener. The sound waves are inverted and played through the speakers of the headphones to cancel out the noise. Inverted signals have also been used to cancel the engine noise in the interior of an automobile. Signals from the engine are used as inputs to a signal generator which outputs an inverted signal to a speaker on the interior of the automobile. In electronic devices, noise cancellation has been implemented to cancel noise output from the back of a cooling fan. A microphone is mounted in the air plenum of the cooling fan and a speaker is fixed relatively close to the back of the fan. The output signal from the microphone is used to drive the speaker inversely to the measured output of the fan.

The prior art approaches described above do not solve the problem of high noise emissions from a thermal printer. Each of the noise cancellation approaches described above is directed to unidirectional noise cancellation, with a speaker at a fixed position close to the listener. These approaches would be undesirable in a thermal printer. For example, it would not be practical for every person in an office to wear headphones or to physically separate the printer from potential listeners. Further, unlike the cooling fan which produces unidirectional noise (from a single noise source with flat wavefronts through a duct out the back of the device) a thermal printer emits noise in various directions from many noise sources, and can be heard by listeners from all sides of the thermal printer and at various distances from the thermal printer.

Thus it would be desirable to provide a simple and inexpensive apparatus for a thermal printer that is capable of omnidirectional noise cancellation without sacrificing printer performance.

SUMMARY OF THE INVENTION

In accordance with the teachings of the present invention, an apparatus for canceling external noise generated by a thermal printer is provided. The noise cancellation apparatus provides an inexpensive mechanism that is readily adaptable for printers and other equipment and devices that are used in areas where it is desirable to minimize external noise.

In an embodiment of the present invention, a thermal printer includes a transport mechanism for transporting a media through the thermal printer and a thermal print head for printing on the media. At least one sound emitter is provided for generating an inverse sound signal to cancel noise generated by at least one noise source in the thermal printer. At least one microphone is provided for receiving sound signals from the at least one noise source. Each microphone is connected to an inversion circuit which inverts the received sound signals. The inversion circuit sends the inverted sound signal to one of the sound emitters, which emits the inverted sound signal, canceling out the noise.

To ensure a proper phase relationship between the inverted sound signal and the sound signals generated by the noise source, the sound emitter is placed as close as possible to the noise source. Further, a low pass filter is provided between the microphone and the inversion circuit to filter out noise having a frequency greater than c/2d, where c is the speed of sound and d is the distance between the emitter and the noise source. Thus, the sound emitter is always within ½ of a cycle from the noise source. Sound dampening materials are disposed in the thermal printer to cancel out the remaining high frequency noise that is within the range of human hearing.

In another embodiment of the present invention, an apparatus for canceling noise in a thermal printer includes at least one sound emitter, a memory including a program memory and a waveform memory, and a processor connected between the memory and the at least one sound emitter. The waveform memory includes a plurality of inverted waveforms and the program memory includes logic for instructing the processor to select an appropriate inverted waveform in accordance with current printing parameters and to synchronize the selected inverted waveform with the noise generated from at least one noise source. The data memory can further include inverted waveforms to compensate for noise generated from accessories such as cutters and self-strip apparatus, motor and gear train whine and enclosure harmonics.

It is recognized that most noise generated from a thermal printer is periodic in nature, thus the selected inverted waveform can be synchronized with a known print speed of the thermal printer. The synchronization can be timed from a step interrupt signal, a print head interrupt signal, known time-delays between certain printing functions, or other repeated printer functions.

The waveform data may be utilized in conjunction with a microphone to provide additional advantages over the prior art. For example, a microphone can be utilized in the manner described above to cancel noises not covered by the waveform data. Further, a microphone can be utilized to provide feedback on the noise level of the thermal printer during use, thus allowing the waveforms to be altered to compensate for changing environmental conditions such as the wear on printer parts or the introduction of new media. It is further contemplated that the emitter of the present invention can be utilized for standard noise output from the printer, such as a beep to indicate an error condition or printer status.

A more complete understanding of noise cancellation for a thermal printer will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for a simple and inexpensive mechanism for providing noise reduction in a thermal transfer printer. In the detailed description that follows, it should be appreciated that like element numerals are used to describe like elements that are illustrated in one or more of the figures.

Figure 1:
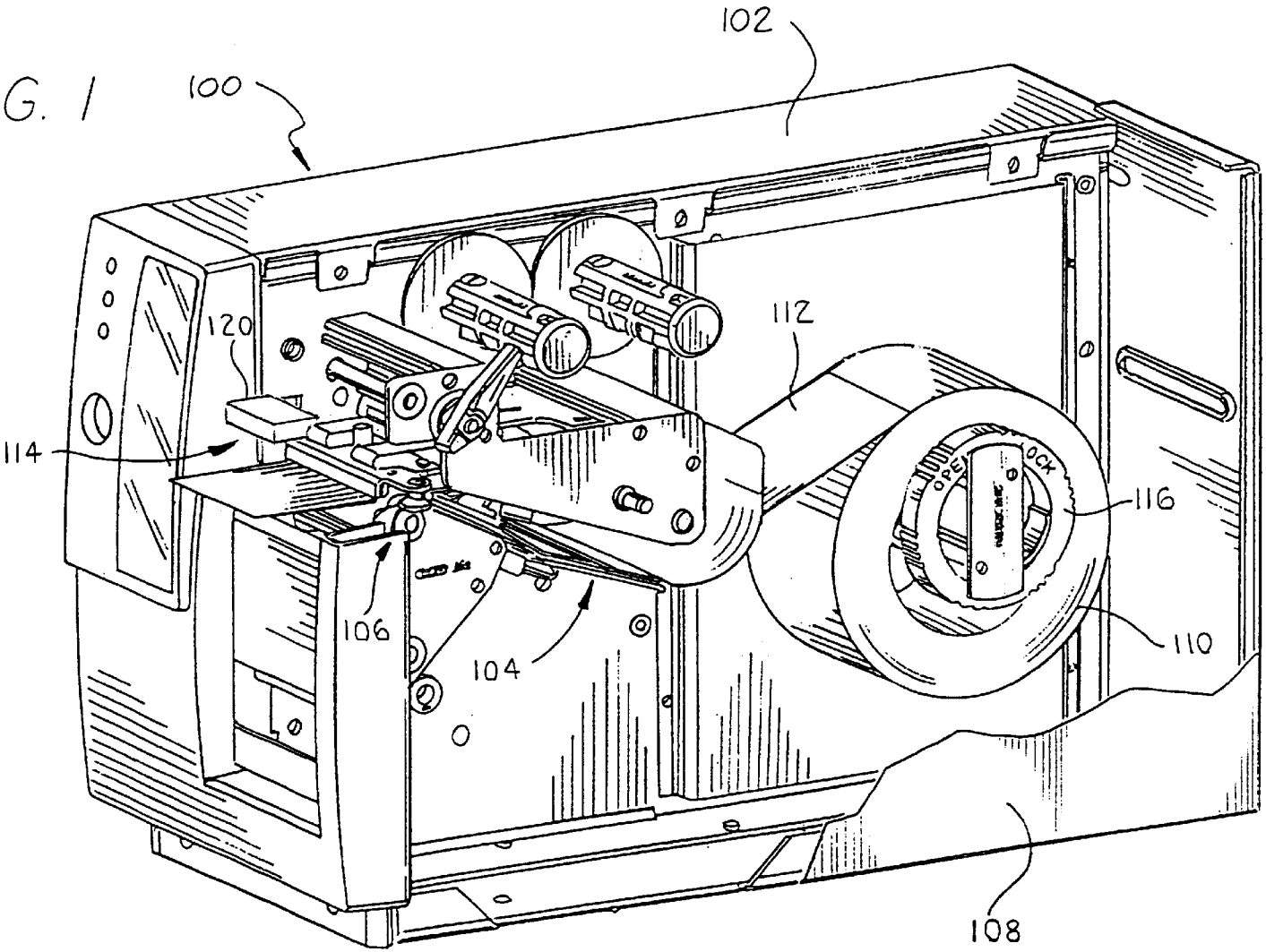
FIG. 1 is a thermal printer utilizing one embodiment of the noise cancellation apparatus of the present invention.

Referring first to FIG. 1, a printer 100 utilizing a noise cancellation apparatus of the present invention is illustrated. The printer 100 includes a housing 102 which encloses the operative elements of the printer, and a transport mechanism 104 that will transport print media to a thermal print head 106. As known in the art, the transport mechanism may further include a platen driven by a motor to draw a web of the print media thereto. It should be understood that these conventional elements of a printer are well known in the art, and therefore further description of these elements is deemed unnecessary.

The housing 102 includes a removable panel 108 that permits access to an internal portion of the printer 100 in which a media supply roll 110 is operatively disposed. A web 112 of the print media is paid out from the media supply roll 110 to the print head of the printer 100 by operation of the transport mechanism 104, and printed media thus exits the printer housing 100 via a media exit opening 114 disposed at a front portion of the printer.

For illustrative purposes, a simplified printer design is shown, however, it should be apparent to those skilled in the art that additional features can be present in the printer, including additional rollers, cutting mechanisms and motors. The thermal printer 100 is shown to illustrate the general principles of the present invention, and through the discussion below, it should be appreciated that the present invention can work equally well with other printer configurations.

During operation, the printer 100 generates noise from various sources such as motors, power transmissions, accessories, media friction, and enclosure harmonics. For example, noise is generated by the friction of the media roll 110 as it rotates on the media post 116. Noise is also generated by the motors that drive the transport mechanism 104, as well as the rollers of the transport mechanism which rotate to transport the media web 112 through the printer.

A primary source of noise in a thermal printer is generated from the print head sticking to the print media. This noise is intrinsic to the thermal printing process, arising from the cyclical heating and cooling of the print head while in contact with the media in combination with the movement of the printing medium. The specific cause of this noise is believed to be associated with an increased adhesion of the printing medium to the print head caused by the heating and cooling cycle. When the motor attempts to move the printing medium to the next column of dots, it must break this adhesion. This breaking of the adhesion causes a momentary noise emission which, when combined with the noise emissions of preceding and successive print lines, produces a noise at the frequency of the printing line scan time as well as harmonics and sub-tones of that frequency. This print head sticking noise is most pronounced at high print speeds. The noise emission is also associated with the particular pattern being printed, which depends upon the number of dots being printed for each line. A higher number of dots per line corresponds to a greater noise emission since the print head will stick to the media at the printed dots, and conversely, a lower number of dots per line corresponds to a lower noise emission.

To reduce noise generated from a noise source, a sound emitter 120 is disposed close to the noise source. The sound emitter 120 emits sound waves in a similar spatial radiation pattern as the noise source and is capable of emitting sound waves at similar amplitudes. The sound emitter 120 can be a piezoelectric emitter, speaker or other sound generating apparatus having the above properties. In operation, the sound emitter 120 emits a cancellation signal to cancel noise generated from the noise source.

Figure 2A:
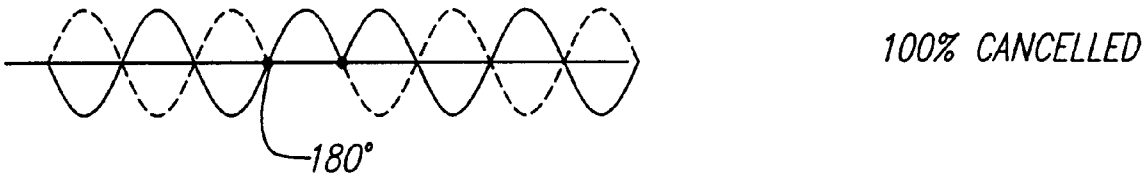
FIGS. 2*a*, 2*b* and 2*c* illustrate the results of various phase relationships between a sound signal and an inverted sound signal.
Figure 2B:
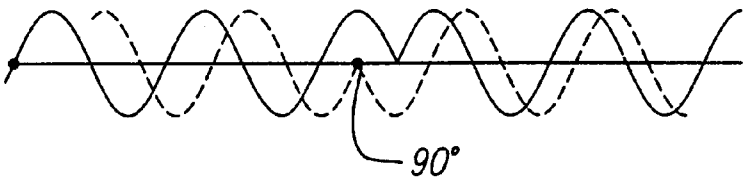
Figure 2C:
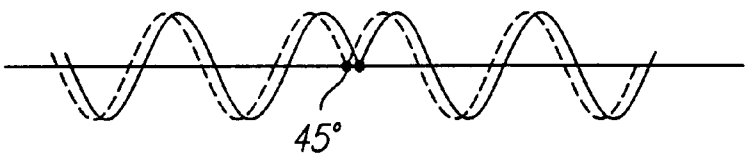

In order to reduce noise with a cancellation signal, the wavefronts of the noise and inverted cancellation signals must be out of phase by no less than 90° and no more than 270°. As illustrated in FIG. 2*a*, total cancellation of the sound wave is accomplished if the inverted cancellation signal is 180° out of phase with the noise signal. As illustrated in FIG. 2*b*, there is zero net cancellation and also zero net reinforcement of the noise signal at 90° and 270°. In between 90° and 270°, there is partial cancellation of the noise. For instance, at 135° the noise is attenuated by half, or −3 dB. As illustrated in FIG. 2*c*, below 90° and greater than 270° there will actually be an increase in the noise generated.

Figure 3:
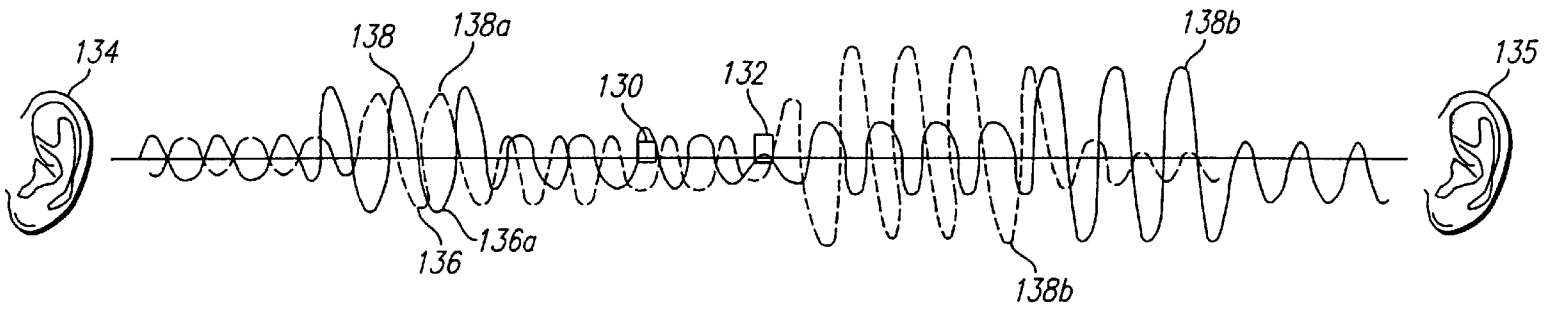
FIG. 3 illustrates the effects of a phase shift between a noise source and a sound emitter.
Figure 4:
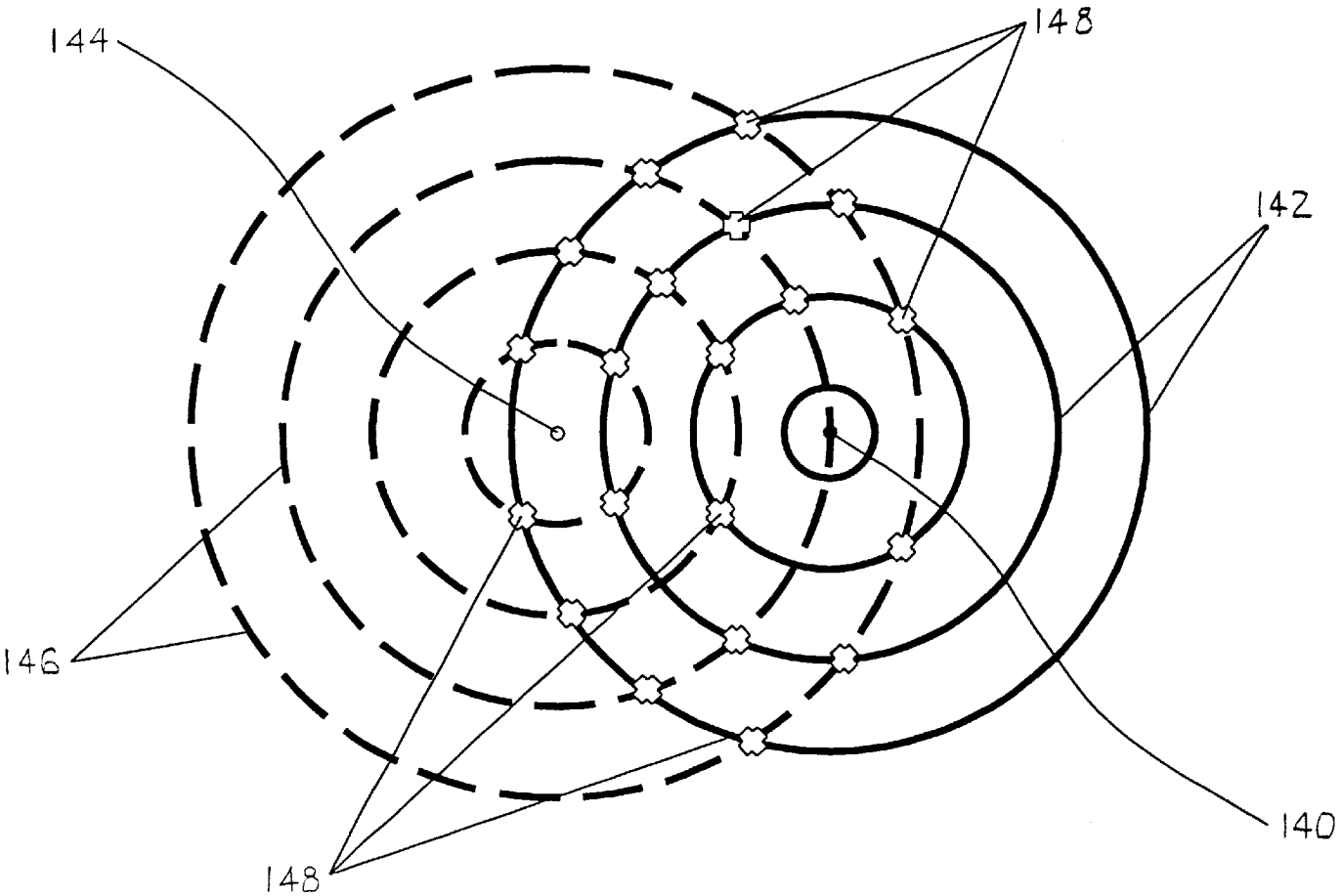
FIG. 4 is a two-dimensional view of wavefronts at a frequency of d/3, where d is the distance between the noise source and a sound emitter.

Cancellation of the omnidirectional noise generated from the printer 100 presents many problems as illustrated in FIGS. 3 and 4. In FIG. 3, a speaker 130 is placed between a noise source 132 and a listener 134, and a cancellation signal 136 is utilized to cancel sound waves 138 in the direction of the listener 134. As illustrated at points 136*a* and 138*a*, the cancellation signal 136 and the sound waves 138 are in phase in the direction of listener 134. However, the cancellation signal 136 does not adequately cancel noise in other directions, and can actually increase the noise towards other listeners such as listener 135. This is due to a relatively large phase shift between the cancellation signal 136 and sound waves 138 at high frequencies due to the physical separation of the sources. As illustrated, the cancellation signal 136 at point 136*a* should cancel the sound signal 138 at point 138*a*; however, the cancellation signal 136 is 4 cycles behind the sound signal 138 in the direction of listener 135. Consequently, the inverted cancellation signal is too strong at point 136*a*, resulting in an increase in noise, and too weak at point 138*a* to cancel the sound signal 138.

FIG. 4 illustrates another problem associated with omnidirectional noise cancellation. A noise source 140 emits sound waves having wavefronts 142. A sound emitter 144 is placed a distance d away from the noise source 140, and emits a cancellation signal having wavefronts 146. The illustrated wavelengths of the sound waves and the cancellation signal are both d/3. The wavefronts 142 and 146 intersect at points 148, creating nodes of constructive interference. As can be seen from FIG. 4, these nodes 148 produce an increase in generated noise at points surrounding both the noise source 140 and the sound emitter 144.

To solve these and other problems associated with omnidirectional noise cancellation, the sound emitter 120 (illustrated in FIG. 1) of a preferred embodiment of the present invention is disposed as close as reasonably practical to the centroid of the generated noise. An inverse signal is emitted from the sound emitter 120 to cancel noise generated by the noise source having a frequency lower than c/2d, where c is the speed of sound and d is the distance between the sound emitter 120 and the noise source. By placing the sound emitter 120 as close as possible to the centroid of the noise and limiting the noise cancellation to low frequencies, the present invention provides a system and method for omnidirectional noise cancellation that is simple, economical and does not degrade printer performance.

Figure 5:
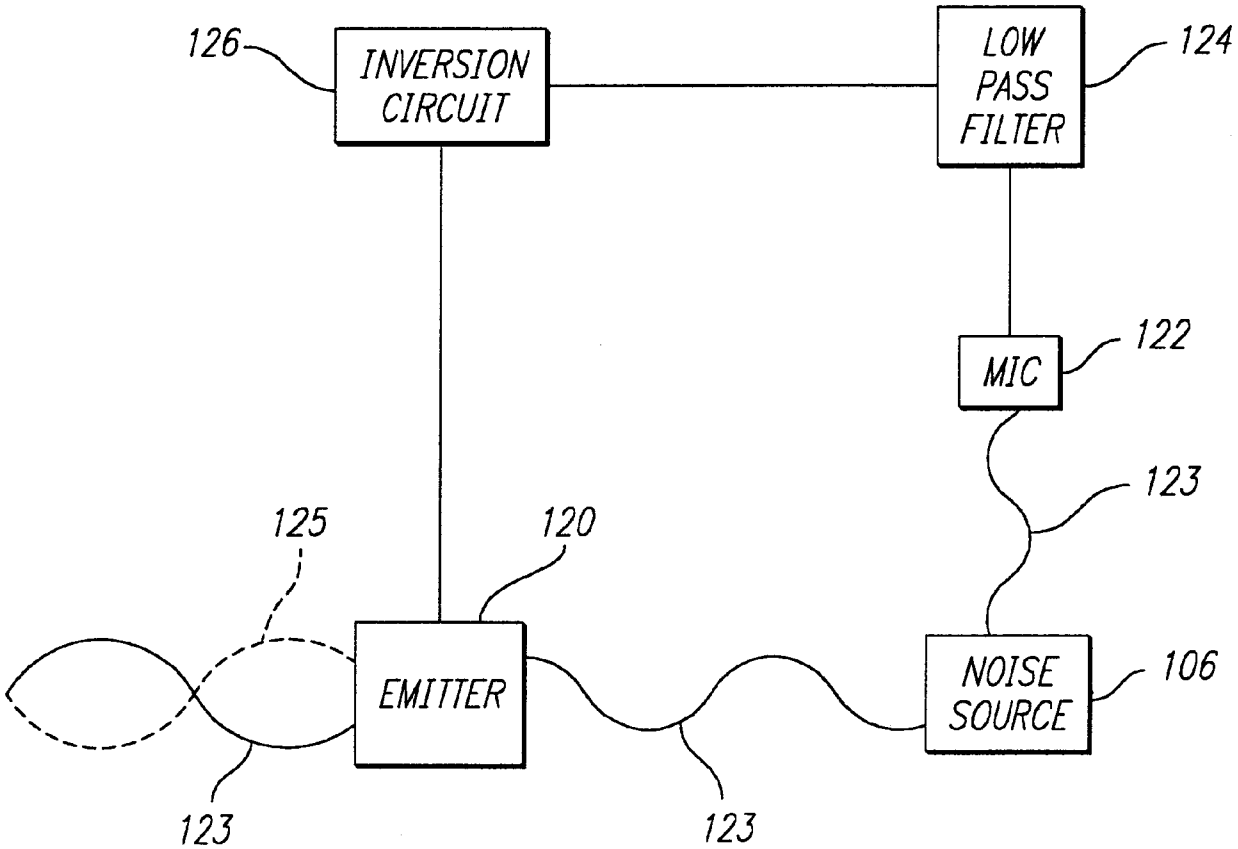
FIG. 5 is a block diagram illustrating a first embodiment of the noise cancellation apparatus of the present invention.

A first embodiment of the noise cancellation apparatus of the present invention will now be described with reference to FIG. 5. A microphone 122 is disposed at the noise source 106 (e.g., print head) to receive the acoustic noise signal 123 generated from the noise source 106. As discussed above, a sound emitter 120 is placed as close as possible to the centroid of the noise source 106 (e.g., as close as possible to the print head). In the preferred embodiment, the sound emitter 120 is a piezoelectric emitter and is placed into the housing of a pre-existing label-taken sensor (not shown). A low pass filter 124 is connected to the microphone 122, and an inversion circuit 126 connects the low pass filter to the sound emitter 120. The low pass filter 124 is adapted to filter out all frequencies higher than c/2d, where c is the speed of sound (e.g., 1150 (ft/sec)) and d is the distance between the sound emitter 120 and the most distal portion of noise source 106.

Operation of the above embodiment will now be described. The acoustic noise signal 123 generated by the noise source 106 is received by the microphone 122 and sent through the low pass filter 124 which filters out frequencies higher than c/2d as provided above. The filtered signal is then sent through the inversion circuit 126 where the signal is inverted and amplified, forming a cancellation signal. The cancellation signal is then sent to the sound emitter 120 which emits the cancellation signal 125, thus canceling out the acoustic noise signal 123.

Figure 6:
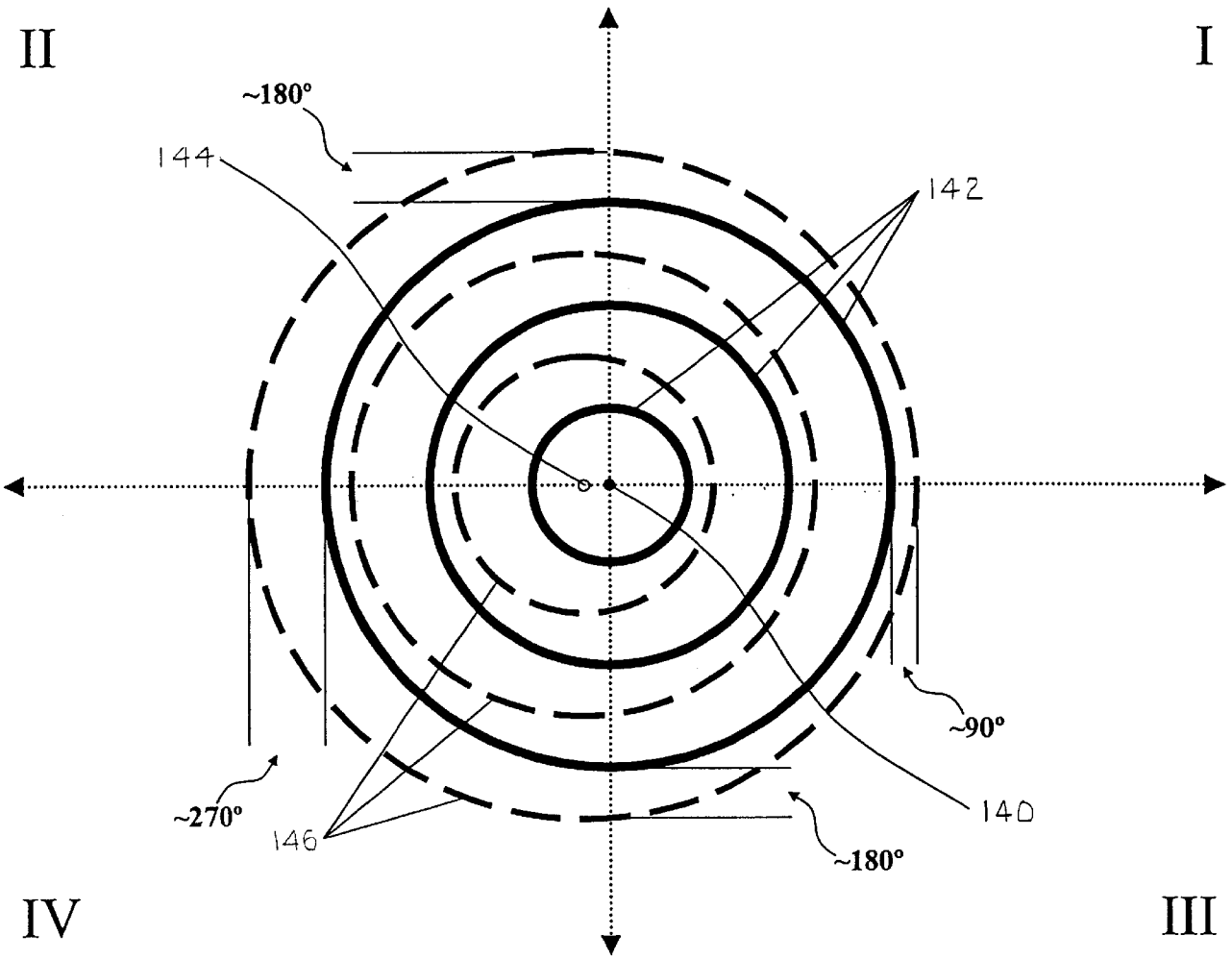
FIG. 6 is a two-dimensional view of wavefronts generated from a noise source and a sound emitter in accordance with an embodiment of the present invention.

Because the sound emitter 120 has the same spatial radiation pattern as the noise source, acoustic noise signals can be reduced in virtually all directions as illustrated in FIG. 6. FIG. 6 illustrates a two-dimensional view of the wavefronts 142 and 146 generated from the noise source 140 and the sound emitter 144, respectively, having a wavelength of 4d. As can be seen, the wavefronts 146 are out of phase with the wavefronts 142 by 90°–270° in every direction, and there are no nodes of constructive interference. The wavefronts 146 completely cancel the wavefronts 142 at points where the signals are out of phase by 180°, and have no net effect at points where the signals are out of phase by 90° and 270°. In between 90° and 270° there is a reduction in the noise generated from noise source 140. Although only two dimensions are illustrated, it should be apparent that the noise source 140 generates noise in a three-dimensional manner and that the sound emitter 144 operates to cancel noise in three dimensions as described above.

It should be appreciated by persons having ordinary skill in the art that the phase shift problem described in FIG. 3 is solved with the present invention. The minimum wavelength of the cancellation signal of the present invention will always be at least twice the distance between the sound emitter 120 and the noise source. Thus, in all directions, the inverted signal will be no more than one cycle away from the corresponding point of the sound wave. In addition, as shown in the FIG. 6, the nodes of constructive interference 148 (illustrated in FIG. 4) are eliminated by the present invention. It should also be appreciated that the closer the sound emitter 120 is placed to the noise source, the higher the frequencies that can be cancelled.

Because the low pass filter limits the sound emitter to frequencies lower than c/2d, some higher frequency noise remains, and this noise may include frequencies within the range of human hearing. This high frequency noise is reduced through the use of sound proofing materials built into the housing 108. It is noted that the reduction of high frequency noise requires less sound proofing material than the reduction of low frequency noise. By placing the sound emitter 120 as close as possible to the centroid of the noise source, the amount of sound proofing material required to dampen the remaining high frequency noise will be greatly reduced.

Although the noise cancellation apparatus illustrated in the above embodiment was provided to cancel noise generated from the print head, it should be apparent to those of ordinary skill in the art that the noise cancellation apparatus can be utilized to cancel out other sources of noise in a thermal printer. Further, it should be apparent that a plurality of noise cancellation devices can be utilized in the same thermal printer to cancel noise generated by a plurality of noise sources.

A second preferred embodiment will now be described with reference to FIG. 6, which illustrates a transport mechanism for a thermal printer. The transport mechanism includes a platen 150, a thermal print head 152, a stepper motor 154 and a continuous motor 156 for rotating a take-up hub. Two primary sources of noise in this embodiment are the thermal print head 152 (i.e., media sticking to thermal print head) and the operation of the motors 154 and 156. However, it should be appreciated that other sources of noise are present, including a roller 158, a gear 160, a pulley 162 and the vibration of the exterior of the printer during operation.

To reduce noise, a first sound emitter 164 is placed as close as possible to the thermal print head 152, and a second sound emitter 166 is placed as close as possible to motors 154 and 156. As in the first embodiment, the first sound emitter 164 operates to cancel out noise due to label sticking to the thermal print head 152. The second sound emitter 166 operates to cancel out noise from the motors 154 and 156.

Figure 7:
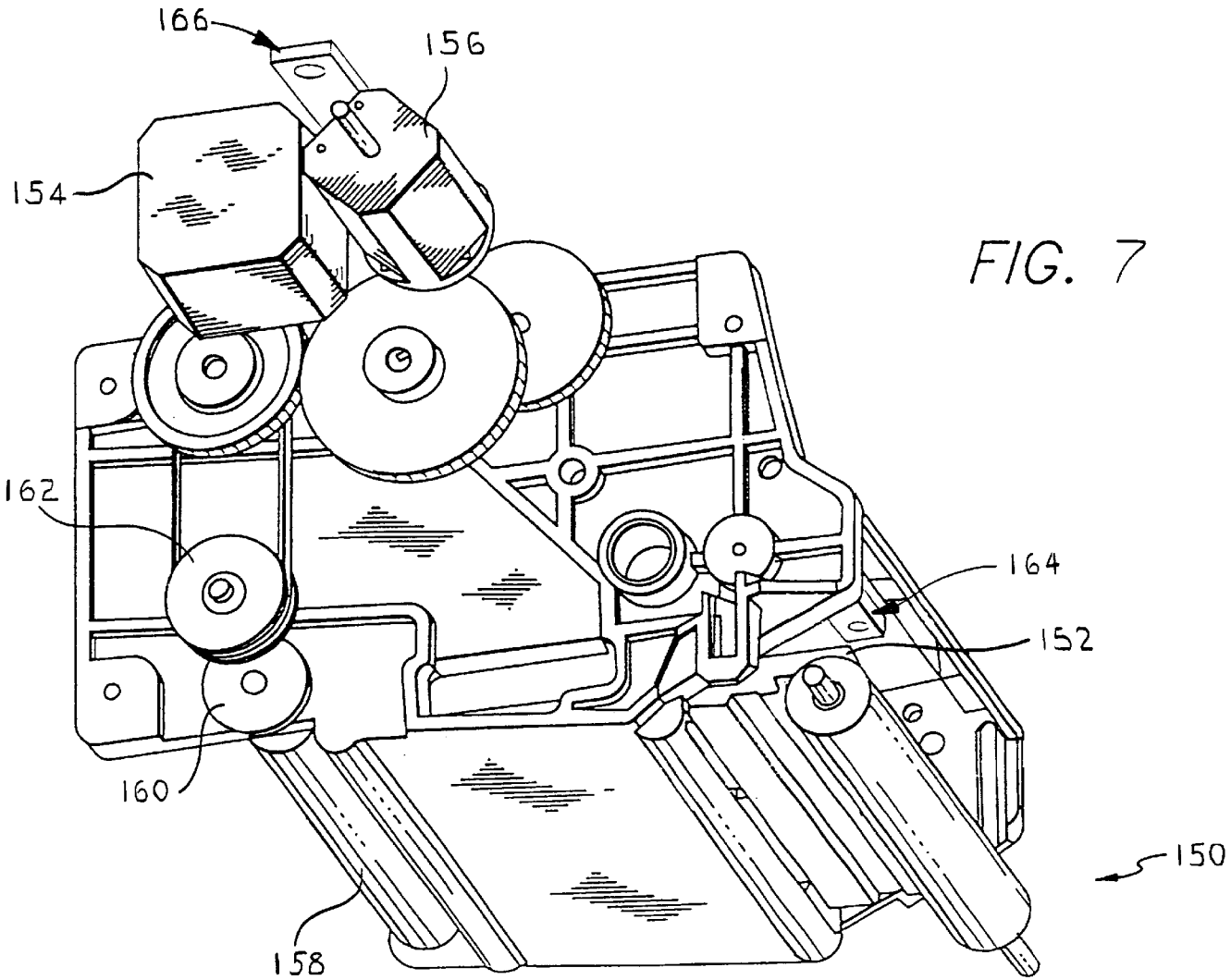
FIG. 7 illustrates a transport mechanism of a thermal printer utilizing a second embodiment of the noise cancellation apparatus of the present invention.

Referring to FIG. 7, a block diagram illustrating the operation of the noise cancellation apparatus is provided. The sound emitters 164 and 166 are connected via a bus 170 to a processor 172, a ROM 174, a RAM 176, a controller 178 for controlling the bus 170, and the stepper motor 154. The ROM 174 includes program instructions 174*a* for controlling the processor 172, and also includes waveform data 174*b*. As will be described below, the waveform data 174*b* includes predetermined inverted waveforms that are sent to the sound emitters 164 and 166 to cancel noise.

Figure 8:
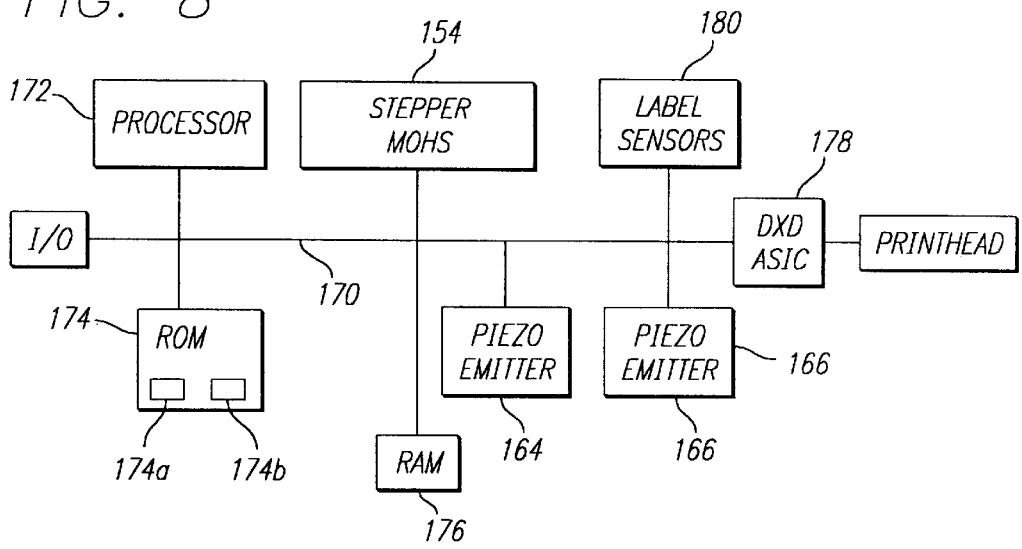
FIG. 8 is a block diagram illustrating the noise cancellation apparatus of the second preferred embodiment.
Figure 9:
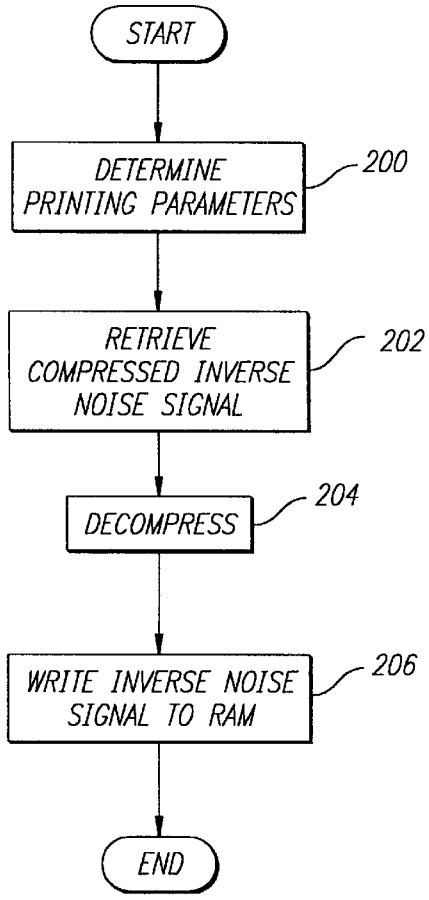
FIG. 9 is a flow chart illustrating the logic for initializing the noise cancellation apparatus of the second preferred embodiment.
Figure 10:
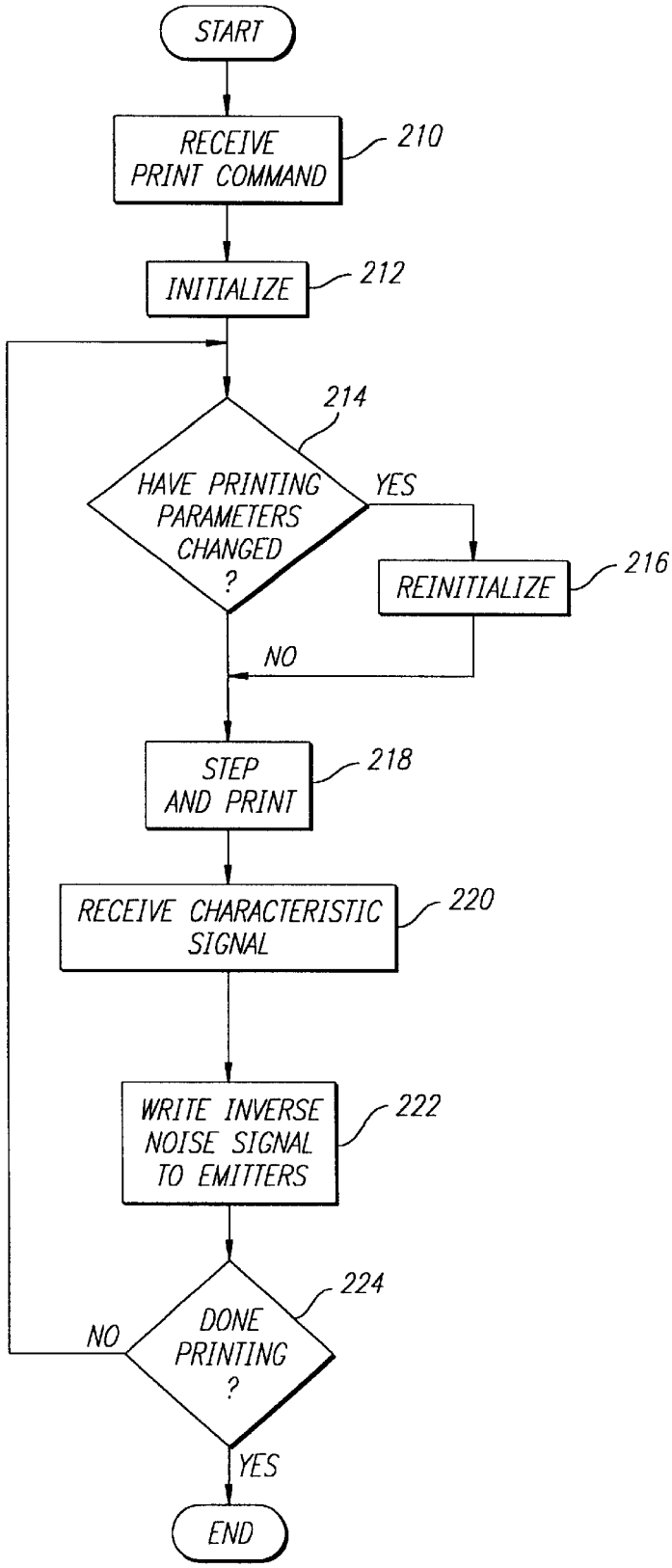
FIG. 10 is a flow chart illustrating the operational logic for the noise cancellation apparatus of the second preferred embodiment.

Operation of the second preferred embodiment will now be described with reference to FIGS. 8 and 9. The noise cancellation apparatus is initialized according to the algorithm shown in FIG. 8. At step 200, the current print parameters are determined. These parameters include print speed, print mode, media type, etc. The print parameters are utilized at step 202 to retrieve an appropriate compressed inverted waveform from the waveform data 174*b*.

Preferably, the waveform data 174*b* for a given thermal printer is created in a laboratory environment. The major sources of noise can be identified and sound emitters can be placed as close as possible to the centroid of each of the identified noise sources. It is noted that noise output from a thermal printer is generally predictable as a function of a printer geometry, print speed, load (media payout force), accessories installed, media type, etc. For example, as each line is printed, the print head heats up the media, and when the next step is taken, the breaking of the adhesion creates noise. Thus, a single inverted waveform can be stored in the printer memory and sent to the sound emitter 120 for each line that is printed to cancel the media sticking noise.

To create the waveform data 174*b*, the noise generated from one or more noise sources is sampled for each set of print parameters. The noise can be sampled using a microphone placed in close proximity to a noise source, similar to the placement of the microphone in the first preferred embodiment. The sampled noise is then sent through a low pass filter to remove sound waves having a frequency higher than c/2d, where c is the speed of sound and d is the distance between the sound emitter and the noise source. The signal is then inverted and edited down to a single repeatable period. The signal will also be smoothed to reduce sound hits between periods. The signal is then compressed and stored as waveform data 174*b* for the given set of print parameters. In operation, the selected inverted waveform is decompressed at step 204 and written to RAM 176 at step 206.

Alternatively, the selected inverted waveform can be generated as a function of the particular pattern being printed. As discussed above, the number of dots printed in a line will correspond to the magnitude of noise generated. For each line, a counter can maintain a count of the number of dots to be printed. The dot count value can then be used as a reference to access a look-up table which identifies stored waveform data 174*b*. As in the foregoing embodiments, the stored waveform data 174*b* may be generated from noise that is sampled from the printer under conditions of different dot counts. The sampled noise is thereafter filtered, inverted, edited and stored in the same manner described above.

Operation of the noise cancellation apparatus will now be described with reference to FIG. 9. A command to begin printing is received at step 210. At step 212, the noise cancellation apparatus is initialized in accordance with the algorithm of FIG. 8. When printing parameters change during printing, the noise cancellation apparatus is reinitialized through steps 214 and 216.

At step 218, the media is moved forward one step and if needed the next line is printed. As discussed in the first preferred embodiment, it is essential to properly synchronize the cancellation signal with the sound generated from the noise source. Thus, the inverse signal is not played through the emitters until a characteristic signal is received at step 220. In the preferred embodiment, the characteristic signal is a step interrupt utilized to drive the stepper motor 154; however, it is contemplated that the inverse noise signal can be synchronized with a print interrupt, or other periodic signal generated by the printer. After the characteristic signal is received, the inverse noise signals will be written to the sound emitters 164 and 166. In a preferred embodiment, the waveforms are stored digitally and played through an A/D converter and then an amplifier before being written to sound emitters 164 and 166. At step 224, if printing is not complete, control is sent back to step 214.

In an alternative embodiment of the invention, the present noise cancellation system may be utilized with the sound emitter disposed close to, but physically separated from, the noise source. For example, a portable printer may be adapted to be carried around a work environment, with sound emitters adapted to cancel noise from the portable printer spaced around the work environment. As in the preceding embodiments, an inverted waveform is emitted and amplified to provide a noise cancellation signal. It should be appreciated that the listener may actually be closer to the noise source than to the sound emitter. Accordingly, for this embodiment, the sampled noise is sent through a low pass filter to remove sound waves having a frequency higher than c/2d, where c is the speed of sound and d is the lesser of a) the distance between the sound emitter and the noise source, and b) the distance between the noise source and the listener.

Having thus described a preferred embodiment of noise cancellation in a thermal printer, it should be apparent to those skilled in the art that certain advantages of the foregoing system have been achieved. It should also be appreciated that various modifications, adaptations, and alternative embodiments thereof may be made within the scope and spirit of the present invention. For example, noise cancellation in a thermal printer has been illustrated, but it should be apparent that the inventive concepts described above would be equally applicable to noise cancellation from other types of office equipment.

Further, the waveform data of the second embodiment may be utilized in conjunction with the microphone from the first embodiment, providing additional advantages over the prior art. For example, a microphone can be utilized in the manner described above to cancel noises not covered by the waveform data. Further, a microphone can be utilized to provide feedback on the noise level of the thermal printer during use, thus allowing the waveforms to be altered to compensate for changing environmental conditions such as the wear on printer parts or the introduction of new media. It is further contemplated that the emitter of the present invention can be utilized for standard noise output from the printer, such as a beep to indicate an error condition or printer status.

The above description is presently the best contemplated mode of carrying out the invention. This illustration is made for the purpose of illustrating the general principles of the invention, and is not to be taken in a limiting sense. The scope of the invention is best determined by reference to following claims.

What is claimed is:

1. An apparatus for canceling external acoustic noise in a thermal printer, said thermal printer generating acoustic noise from at least one noise source, said apparatus comprising:

means for creating a cancellation signal, said cancellation signal being the inverse of the acoustic noise generated from said at least one noise source; and a sound emitter connected to said creating means, said sound emitter adapted to emit said cancellation signal in a spatial radiation pattern similar to said at least one noise source, said sound emitter being placed close to a centroid of said at least one noise source;

wherein said generated acoustic noise is cancelled out by said emitted cancellation signal.

2. The apparatus of claim 1, wherein said sound emitter is a piezoelectric emitter.

3. The apparatus of claim 1, wherein said means for creating a cancellation signal comprises:

a microphone for receiving said generated acoustic noise, said microphone being placed in close proximity to the centroid of said generated acoustic noise; and an inversion circuit connected to said microphone for inverting said generated acoustic noise received by said microphone, thereby providing said cancellation signal.

4. The apparatus of claim 3, wherein said means for creating a cancellation signal further comprises a low pass filter connected between said microphone and said inversion circuit.

5. The apparatus of claim 4, wherein said low pass filter is adapted to filter out portions of said generated acoustic noise received by said microphone that have a frequency higher than c/2d, where c is the speed of sound and d is the distance between the sound emitter and the at least one noise source.

6. The apparatus of claim 1, wherein said means for creating a cancellation signal comprises:

a data memory storing inverted waveform data;

a processor; and a program memory storing program instructions for controlling said processor, said program instructions comprising the steps of selecting an inverted waveform from said data memory, and sending said selected inverted waveform to said sound emitter.

7. The apparatus of claim 6, wherein said means for creating a cancellation signal further comprises:

means for synchronizing said selected inverted waveform with said generated acoustic noise thereby defining a phase relationship therebetween such that said selected inverted waveform reduces said generated acoustic noise.

8. The apparatus of claim 4, wherein said selected inverted waveform is synchronized with said generated acoustic noise in accordance with a number of dots in a printed pattern of said thermal printer.

9. The apparatus of claim 4, wherein said selected inverted waveform is synchronized with said generated acoustic noise in accordance with a known print speed of said thermal printer.

10. The apparatus of claim 9, wherein said known print speed is measured from a step interrupt signal.

11. The apparatus of claim 9, wherein said known print speed is measured from a print interrupt signal.

12. The apparatus of claim 6, wherein said data memory includes inverted waveforms for canceling acoustic noise generated from noise sources including printer accessories.

13. The apparatus of claim 6, wherein said data memory includes inverted waveforms for canceling acoustic noise generated from noise sources including motors and gear trains.

14. The apparatus of claim 6, wherein said inverted waveform data only contains frequencies equal to or lower than c/2d, where c is the speed of sound and d is the distance between the sound emitter and the at least one noise source.

15. The apparatus of claim 6, wherein said inverted waveform data only contains frequencies equal to or lower than c/2d, where c is the speed of sound and d is the lesser of a) distance between the sound emitter and the at least one noise source, and b) distance between the noise source and a listener.

16. A thermal printer comprising:

a thermal print head for printing information onto a paper substrate material;

a transport mechanism for transporting said paper substrate material under said print head; and a first noise cancellation device for canceling acoustic noise generated from a first noise source in said thermal printer, said first noise cancellation device being disposed close to said first noise source;

wherein said first noise cancellation device emits a cancellation signal in a spatial radiation pattern similar to that of said first noise source, said cancellation signal being the inverse of the acoustic noise generated from said first noise source, thereby reducing said acoustic noise generated from said first noise source.

17. The thermal printer of claim 16, wherein said first noise cancellation device further comprises:

means for creating said cancellation signal, said cancellation signal being the inverse of the acoustic noise generated from said first noise source; and a sound emitter receiving said cancellation signal and emitting said cancellation signal in a special radiation pattern similar to a radiation pattern of said first noise source, said sound emitter being placed as close as practical to a centroid of said first noise source.

18. The thermal printer of claim 17, wherein said means for creating a cancellation signal comprises:

a microphone for receiving said generated acoustic noise, said microphone being placed in close proximity to said first noise source; and an inversion circuit connected to said microphone for inverting said generated acoustic noise received by said microphone, thereby creating said cancellation signal.

19. The thermal printer of claim 17, wherein said means for creating a cancellation signal comprises:

a data memory storing inverted waveform data;

a processor; and a program memory storing program instructions for controlling said processor, said program instructions comprising the steps of selecting an inverted waveform from said data memory, and sending said selected inverted waveform to said sound emitter.

20. The thermal printer of claim 16, further comprising:

a second noise cancellation apparatus for canceling acoustic noise generated from a second noise source in said thermal printer, said second noise cancellation apparatus being disposed as close as practical to said second noise source.

21. The thermal printer of claim 17, wherein said sound emitter is further utilized by said thermal printer for sound output to indicate error conditions.

22. A method of reducing external acoustic noise generated from an office machine, said method comprising the following steps:

locating an acoustic noise source in said office machine;

disposing a sound emitter as close as practical to said acoustic noise source; and generating a signal through said sound emitter in a similar spatial radiation pattern as the acoustic noise generated from said acoustic noise source, said signal being inverse to the acoustic noise generated from said acoustic noise source and said signal not including frequencies higher than c/2d, where c is the speed of sound and d is the distance between the sound emitter and the acoustic noise source.

23. The method of claim 22, further comprising the step of disposing soundproofing materials in a housing of said office machine to reduce acoustic noise generated from said acoustic noise source having a frequency higher than c/2d.

* * * * *